US009412545B2

(12) United States Patent
Kubono et al.

(10) Patent No.: US 9,412,545 B2
(45) Date of Patent: Aug. 9, 2016

(54) ELECTROMAGNETIC RELAY

(71) Applicant: FUJITSU COMPONENT LIMITED, Tokyo (JP)

(72) Inventors: Kazuo Kubono, Tokyo (JP); Yoichi Hasegawa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/450,330

(22) Filed: Aug. 4, 2014

(65) Prior Publication Data

US 2015/0054605 A1 Feb. 26, 2015

(30) Foreign Application Priority Data

Aug. 26, 2013 (JP) ..... 2013-174996

(51) Int. Cl.

| | |
|---|---|
| ***H01H 9/00*** | (2006.01) |
| ***H01H 50/60*** | (2006.01) |
| ***H01H 50/18*** | (2006.01) |
| ***H01H 50/36*** | (2006.01) |
| ***H01H 9/44*** | (2006.01) |
| ***H01H 50/54*** | (2006.01) |
| *H01H 9/36* | (2006.01) |

(52) U.S. Cl.

CPC ..... *H01H 50/60* (2013.01); *H01H 9/443* (2013.01); *H01H 50/18* (2013.01); *H01H 50/36* (2013.01); *H01H 50/546* (2013.01); *H01H 9/36* (2013.01)

(58) Field of Classification Search

CPC ..... H01H 50/54; H01H 33/60; H01H 9/44; H01H 9/443; H01H 9/30; H01H 1/00; H01H 67/02

USPC ..... 335/177

See application file for complete search history.

(56) References Cited

U.S. PATENT DOCUMENTS

| | | | | |
|---|---|---|---|---|
| 5,546,061 | A * | 8/1996 | Okabayashi et al. | 335/78 |
| 6,700,466 | B1 * | 3/2004 | Yamamoto et al. | 335/132 |
| 7,157,996 | B2 * | 1/2007 | Enomoto et al. | 335/132 |
| 7,859,373 | B2 * | 12/2010 | Yamamoto et al. | 335/126 |
| 7,911,301 | B2 * | 3/2011 | Yano et al. | 335/131 |
| 7,924,123 | B2 * | 4/2011 | Yano et al. | 335/132 |
| 8,138,872 | B2 * | 3/2012 | Yoshihara et al. | 335/281 |
| 8,164,404 | B2 * | 4/2012 | Kamiya et al. | 335/201 |
| 8,937,518 | B2 * | 1/2015 | Suzuki | H01H 9/443 335/126 |
| 8,941,453 | B2 * | 1/2015 | Yano | H01H 1/66 335/131 |
| 2009/0237191 | A1 * | 9/2009 | Yano et al. | 335/202 |
| 2009/0322453 | A1 * | 12/2009 | Kawaguchi et al. | 335/81 |

(Continued)

FOREIGN PATENT DOCUMENTS

| | | |
|---|---|---|
| JP | 4840533 | 12/2011 |

*Primary Examiner* — Shawki S Ismail
*Assistant Examiner* — Lisa Homza
(74) *Attorney, Agent, or Firm* — IPUSA, PLLC

(57) ABSTRACT

An electromagnetic relay includes a contact part including a fixed contact and a movable contact, the movable contact being displaceable in an approaching/separating direction with respect to the fixed contact; a drive part including a coil, a movable core, and a fixed core, the movable core being connected to the movable contact via an axial core, and the fixed core including a first plate member having a through hole through which the axial core is inserted and a second plate member that encapsulates the coil; and a permanent magnet polarized in a direction substantially perpendicular to the approaching/separating direction. The first plate member or the second plate member includes an extension part that extends toward the contact part, the extension part being configured to hold the permanent magnet.

4 Claims, 9 Drawing Sheets

(56) References Cited

U.S. PATENT DOCUMENTS

2010/0207713 A1* 8/2010 Sugisawa ..... 335/192
2010/0289604 A1* 11/2010 Kojima et al. ..... 335/133
2011/0221548 A1* 9/2011 Yoshihara et al. ..... 335/185
2012/0092094 A1* 4/2012 Lee ..... 335/78
2013/0127571 A1* 5/2013 Takaya et al. ..... 335/201
2013/0228552 A1* 9/2013 Kashimura et al. ..... 218/26
2014/0232489 A1* 8/2014 Kubono et al. ..... 335/83
2015/0022296 A1* 1/2015 Takaya et al. ..... 335/201

* cited by examiner

ELECTROMAGNETIC RELAY

BACKGROUND OF THE INVENTION

1. Field of the Invention

The present invention relates to an electromagnetic relay.

2. Description of the Related Art

In electromagnetic relays, passage and blockage of a current in an electric circuit is realized by opening/closing a contact part including a fixed contact and a movable contact. When the fixed contact and the movable contact are separated from each other from a contacting state, or when the fixed contact and the movable contact come closer to each other from a separated state as a result of the movable contact being moved toward/away from the fixed contact, an arc may occur when the voltage exceeds a minimum arc voltage or when the current exceeds a minimum arc current (See e.g. Japanese Patent No. 4840533).

In light of the above, an arc extinction technique is used in electromagnetic relays that relies on the fact that an arc has substantially the same magnetic characteristics as a current and utilizes the magnetic flux of a permanent magnet positioned near the contacts. The technique involves extinguishing an arc by having a magnetic force based on Fleming's left-hand rule (Lorenz force) act on the arc so that the arc may be bent, deflected, and blown away. However, according to the technique disclosed in Japanese Patent No. 4840533, the permanent magnet is held by a dedicated yoke. As a result, the number of processes and the number of components may be increased to thereby cause a cost increase.

Accordingly, there is a demand for an electromagnetic relay that is capable of adequately performing arc extinction without causing a cost increase.

SUMMARY OF THE INVENTION

According to one embodiment of the present invention, an electromagnetic relay is provided that includes a contact part including a fixed contact and a movable contact, the movable contact being displaceable in an approaching/separating direction with respect to the fixed contact; a drive part including a coil, a movable core, and a fixed core, the movable core being connected to the movable contact via an axial core, and the fixed core including a first plate member having a through hole through which the axial core is inserted and a second plate member that encapsulates the coil; and a permanent magnet polarized in a direction substantially perpendicular to the approaching/separating direction. The first plate member or the second plate member includes an extension part that extends toward the contact part, the extension part being configured to hold the permanent magnet.

According to an aspect of the present invention, an electromagnetic relay may be provided that is capable of adequately performing arc extinction without causing a cost increase.

DESCRIPTION OF THE EMBODIMENTS

In the following, embodiments of the present invention will be described with reference to the accompanying drawings.

Figure 1:
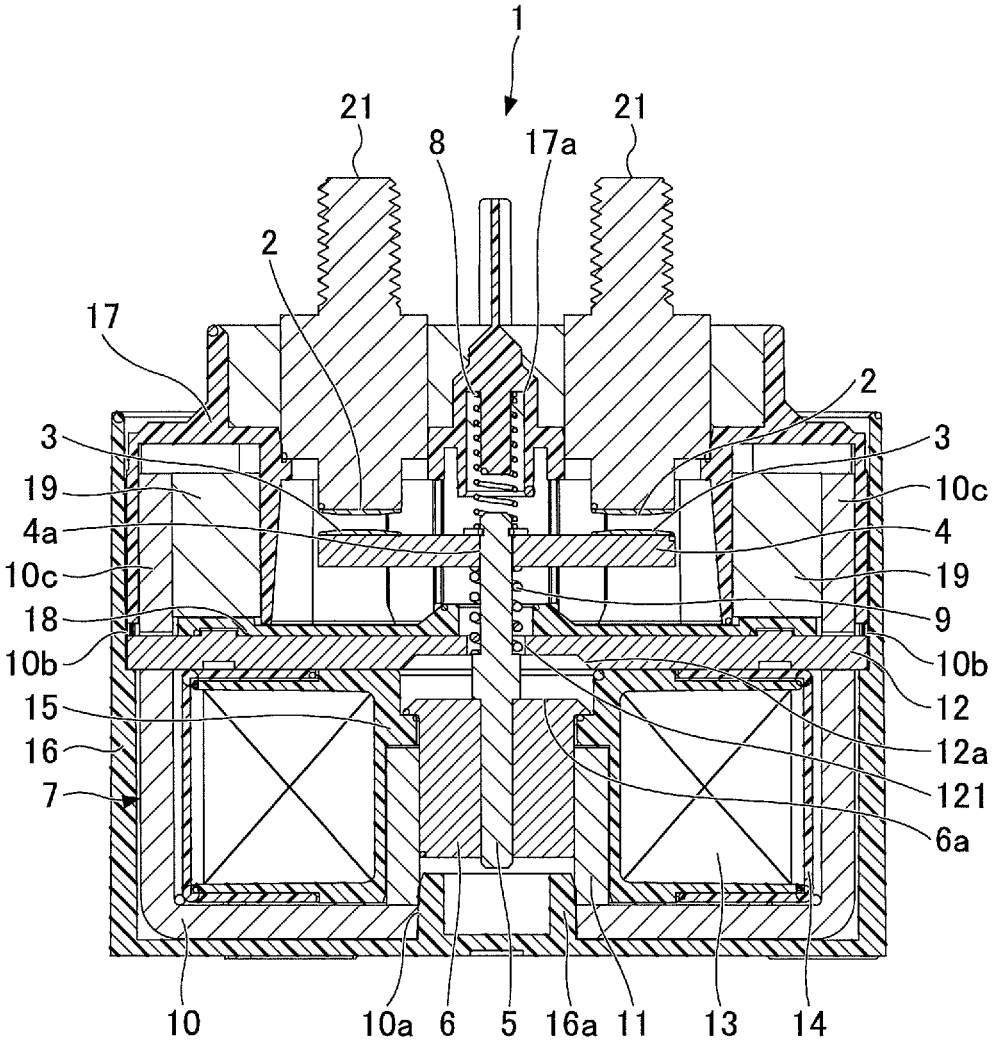
FIG. 1 is a cross-sectional view of an electromagnetic relay according to an embodiment of the present invention along a central axis line of a shaft.

As illustrated in FIG. 1, an electromagnetic relay 1 according to an embodiment of the present invention includes a contact part including a pair of fixed contacts 2 and a pair of movable contacts 3 each corresponding to one of the fixed contacts 2. The movable contacts 3 are displaceable in directions toward and away from the fixed contacts 2. The electromagnetic relay 1 also includes a movable element 4 that holds the pair of movable contacts 3. The movable element 4 is configured to be movable in the directions toward and away from the fixed contacts 2. The electromagnetic relay 1 further includes a shaft 5 (axial core) and a plunger 6 (movable core). The shaft 5 is connected to the movable element 4. The plunger 6 is connected to the shaft 5 and is displaceable. Note that in the following descriptions, with respect to the displacement directions of the movable element 4, a moving direction of the movable contact 3 moving closer to the fixed contact 2; namely, the moving direction of the movable contact 3 toward the fixed contact 2 is referred to as "approaching direction", and a moving direction of the movable contact 3 moving away from the fixed contact 2 or the direction opposite the approaching direction is referred to as "separating direction".

The electromagnetic relay 1 further includes a drive part 7 configured to drive the plunger 6 in the approaching direction (upward direction in FIG. 1), a return spring 8 configured to urge the shaft 5 in the separating direction (downward direction in FIG. 1), and a pressure spring 9 configured to urge the movable element 4 in the approaching direction.

As illustrated in FIG. 1, the drive part 7 includes a yoke 10 (second plate member), a yoke 11, and a yoke 12 (first plate member) as magnetic members making up a fixed core. The drive part 7 also includes an insulation barrier 14 for securing insulation between the yoke 10 and a coil 13. The yoke 10 is formed by bending one piece of plate member into a U-shaped configuration. The yokes 10-12 are yoke components of a magnetic circuit. The electromagnetic relay 1 also includes a reel-shaped bobbin 15 to which the coil 13 is wound. The bobbin 15 and the insulation barrier 14 may be made of synthetic resin, for example.

The electromagnetic relay 1 of the present embodiment includes a drive part housing 16, a contact part housing 17, and a connection housing 18, as illustrated in FIG. 1. The drive part housing 16 may be made of molded resin, for example. The drive part housing 16 may be arranged into a box structure having a bottom to accommodate the drive part 7 described above. The connection housing 18 and the contact part housing 17 may also be made of molded resin, for example.

A substantially cylindrical protruding part 16*a* is arranged at the bottom of the drive part housing 16, and a hole 10*a* with a diameter greater than the diameter of the protruding part 16*a* is formed at the bottom of the yoke 10. Also, the yoke 10 has a notch 10*b* for engaging the yoke 12, and a pair of extension parts 10*c* that extend toward the contact part from the yoke 12 upon being assembled. The pair of extension parts 10*c* holds a corresponding pair of plate-shaped permanent magnets 19 by magnetic force. The permanent magnets 19 are polarized in directions substantially perpendicular to the approaching/separating directions of the contact part.

Figure 2:
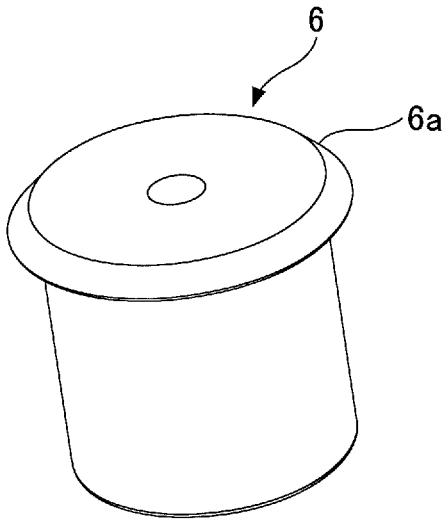
FIG. 2 is a perspective view of a convex part of a plunger of the electromagnetic relay according to an embodiment of the present invention.
Figure 3:
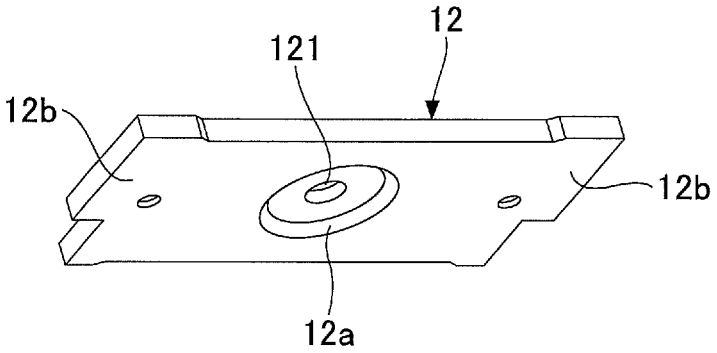
FIG. 3 is a perspective view of a concave part of a yoke of the electromagnetic relay according to an embodiment of the present invention.
Figure 4:
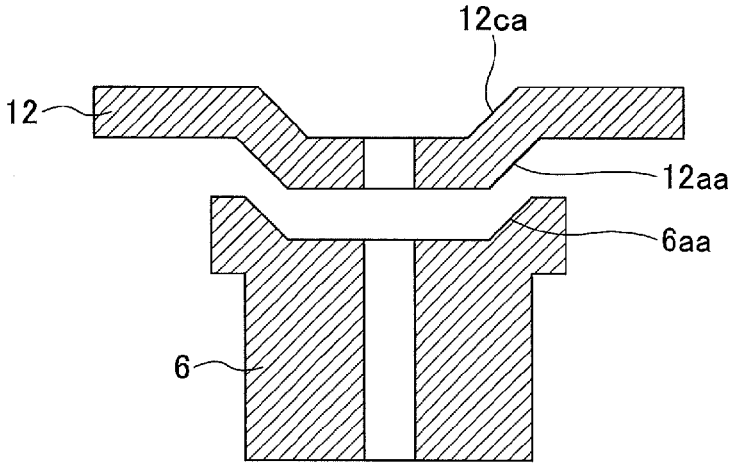
FIG. 4 schematically illustrates a concave part of the plunger, a convex part of the yoke, and a backside concave part of the yoke of the electromagnetic relay according to an embodiment of the present invention.

As illustrated in FIG. 2, the plunger 6 has a convex part 6*a* with a truncated cone configuration arranged at a side facing the yoke 12. As illustrated in FIG. 3, the yoke 12 has a concave part 12*a* corresponding to the shape of the convex part 6*a*. A through hole 121 through which the shaft 5 is inserted is formed at the center of the concave part 12*a*. Also, as illustrated in FIG. 3, the yoke 12 has an engagement piece 12*b* for engaging the notch 10*b* of the yoke 10. Note that in an alternative embodiment, the concave and convex configurations of the plunger 6 and the yoke 12 may be reversed as illustrated in FIG. 4. That is, the plunger 6 may have a concave part 6*aa* and the yoke 12 may have a convex part 12*aa*, for example. Note that the convex part 6*a* or the concave part 6*aa* of the plunger 6 may be formed through a cutting operation, for example. Also, the concave part 12*a* or the convex part 12*aa* may be formed by pressing the yoke 12, for example.

When the yoke 10 and the yoke 11 are mounted to the drive part housing 16, the protruding part 16*a* penetrates through the hole 10*a* and is inserted into the inner peripheral side of the yoke 11. The yoke 11 is arranged into a cylindrical shape and is positioned by the protruding part 16*a*. The yoke 10 is held between and positioned by the side walls of the drive part housing 16.

After mounting the yokes 10 and 11, the bobbin 15 having the insulation barrier 14 attached thereto is inserted into the drive part housing 16 from the upper side, and an assembly of the plunger 6 and the shaft 5 is inserted into the yoke 11. Then, the engagement piece 12*b* is inserted into the notch 10*b* of the yoke 10 so that the yoke 12 may be positioned at the top, and the shaft 5 is inserted through the through hole 121 to assemble the drive part 7. Further, the connection housing 18 corresponding to a resin molded member arranged into a plate including a configuration for enabling engagement with the contact part housing 17 is mounted on top of the yoke 12.

Further, the upper side of the shaft 5 is inserted through the pressure spring 9 and is fit into a hole 4*a* of the movable element 4. Also, an end part of the shaft 5 that protrudes from the upper side of the movable element 4 is inserted into the return spring 8 so that a separating direction side end (lower end in FIG. 1) of the return spring 8 comes into contact with the upper face of the movable element 4.

The contact part housing 17 is configured to fix in place a pair of substantially cylindrical fixed terminals 21 having the fixed contacts 2 arranged at their ends. The contact part housing 17 is inserted from the opening of the drive part housing 16 and is fit into the drive part housing 16. In this way, the contact part housing 17 arranges the fixed contacts 2 to face the movable contacts 3. Further, the contact part housing 17 includes a hole 17*a* for holding and fixing in place an approaching direction side end (upper end) of the return spring 8. The contact part housing 17 holds the outer faces of the extension parts 10*c* and the inner faces of the permanent magnets 19. Further, engaging portions of the contact part housing 17 may be bonded, welded, or brazed to the drive part housing 16 after which a sealing process may be conducted as is necessary.

Figure 5:
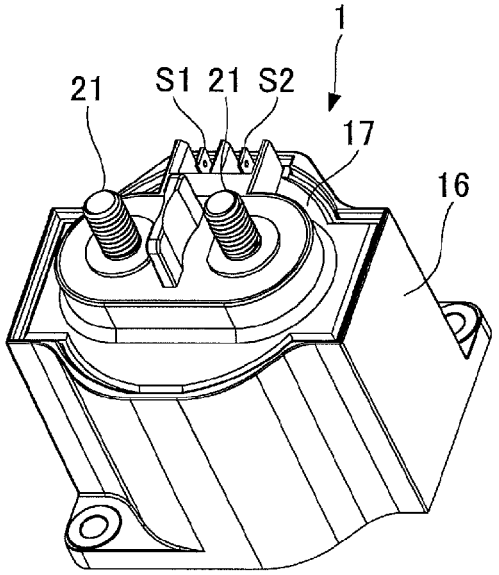
FIG. 5 is an external perspective view of the electromagnetic relay according to an embodiment of the present invention.

FIG. 5 illustrates an exemplary external view of the electromagnetic relay 1 after being assembled in the above-described manner. In FIG. 5, two terminals S1 and S2 for inserting the electromagnetic relay 1 of the present embodiment into a DC circuit are exposed from the contact part housing 17.

Figure 6:
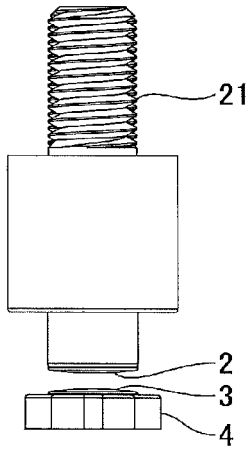
FIG. 6 schematically illustrates a fixed contact and a movable contact of the electromagnetic relay according to an embodiment of the present invention.

Note that the fixed terminals 21 each correspond to one of the fixed contacts 2. The fixed contacts 2 are arranged at the separating direction side ends (lower ends in FIG. 1) of the fixed terminals 21 at positions facing opposite the movable contacts 3. In a preferred embodiment, the fixed contacts 2 and the movable contacts 3 are both arranged to have spherical curvature surfaces such that their points of contact are limited to their centers as illustrated in FIG. 6. The fixed contacts 2 and the movable contacts 3 may both be made of a copper-based material or a precious metal material, for example. The movable element 4 is arranged into a plate shape extending in the radial directions of the shaft 5, and the movable contacts 3 are arranged at side ends of the plate-shaped movable element 4.

As described above, the electromagnetic relay 1 according to the present embodiment is a plunger type relay having a pair of contacts arranged at the left and right hand sides. In the present embodiment, the fixed terminals 21 arranged at the left and right hand sides as illustrated in FIG. 1 are inserted at corresponding locations of a DC circuit that is to be connected/disconnected. A terminal part of the coil 13 of the drive unit 7 may be connected to an input/output (I/O) interface of a PWM control circuit (not shown), for example, and in this way, an excitation current applied to the terminal part of the coil 13 may be controlled as desired.

In a state where no excitation current is applied to the terminal part of the coil 13, the shaft 5 is urged toward the lower side of FIG. 1 by an urging force of the return spring 8 such that the fixed contact 2 and the movable contact 3 transition to an open state or are maintained in the open state. In the state illustrated in FIG. 1, the shaft 5 pushes the plunger 6 from the upper side toward the lower side of FIG. 1 by the urging force of the return spring 8 such that the bottom part of the plunger 6 is held in contact with the protruding part 16*a* of the drive part housing 16.

When an excitation current is applied to the terminal part of the coil 13, the coil 13 and the yokes 10-12 generate an attraction force that draws the plunger 6 toward the upper side of FIG. 1, and as a result, the plunger 6 is pushed toward the upper side causing the shaft 5 and the movable element 4 to move toward the upper side. In this way, the movable contact 3 comes into contact with the fixed contact 2 to thereby transition to a closed state, or the closed state of the movable contact 3 and the fixed contact 2 is maintained in such a state.

If an arc occurs during the opening and closing operations of the contacts, the arc is blown away in the direction in which a Lorentz force acts, such direction being determined based on the direction of the current flowing in the approaching/separating directions as described above and the polarity direction of the permanent magnets 19. In the present embodiment, the direction in which the Lorentz force acts corresponds to the parallel alignment direction of the contacts and a direction substantially perpendicular to the polarity direction of the permanent magnets 19.

Figure 7:
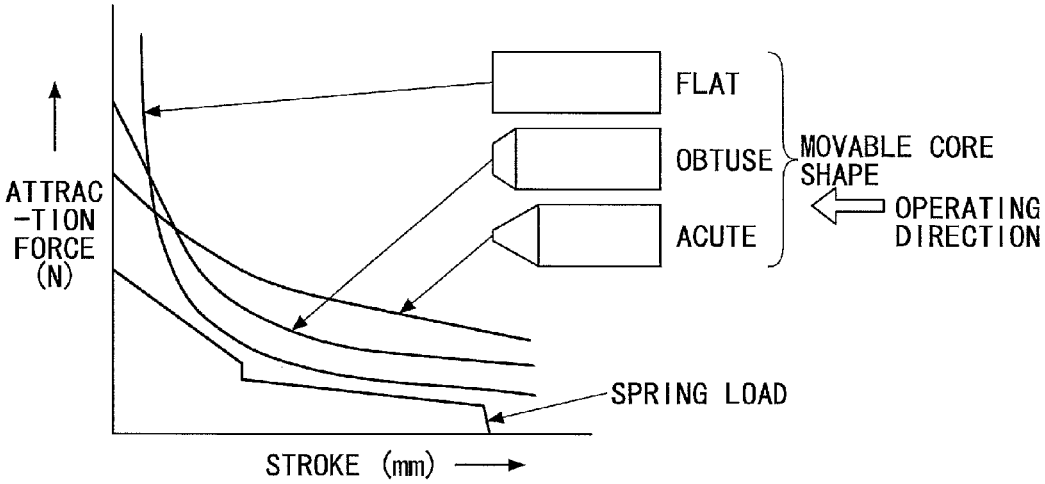
FIG. 7 is a graph illustrating stroke and attraction force characteristics of the electromagnetic relay according to an embodiment of the present invention.

As illustrated in FIG. 7, the stroke and attraction force characteristics of the movable core (plunger) may vary depending on the configuration of the convex part of the movable core. That is, the above characteristics may vary depending on whether the truncated cone configuration of the convex part of the movable core is arranged into an obtuse cone, whether the convex part of the movable core is arranged into an acute cone with a smaller top surface and a larger side surface compared to the obtuse cone (i.e., closer to a triangle in side view), or whether the movable core has no convex part and is arranged to be flat. As can be appreciated from FIG. 7, when the movable core has a convex part that is arranged into an obtuse cone or an acute cone, the attraction force is smaller in a lower stroke region compared to the case where the movable core is flat. Also, with respect to the spring load characteristics illustrated in FIG. 7, the movable core with the obtuse cone configuration has a higher load following capability compared to the movable core with the acute cone configuration in a high stroke region, and the movable core with the acute cone configuration has a higher load following capability compared to the movable core with the obtuse cone configuration in the low stroke region. Note that the above principle similarly applies to a case where the movable core is arranged to have a concave part and the yoke 12 is arranged to have a convex part.

In the electromagnetic relay 1 according to the present embodiment, the attraction force with respect to the stroke may be adjusted by adjusting the ratio of the side surface to the top surface of the truncated cone configuration of the convex part 6*a* or the concave part 12*a*. That is, in the electromagnetic relay 1 according to the present embodiment, the fixed core does not need to have a cylindrical fixed core part corresponding to the convex part 6*a* of the plunger 6. In this way, operating characteristics may be optimized while reducing the number of components and reducing costs, for example.

Figure 8:
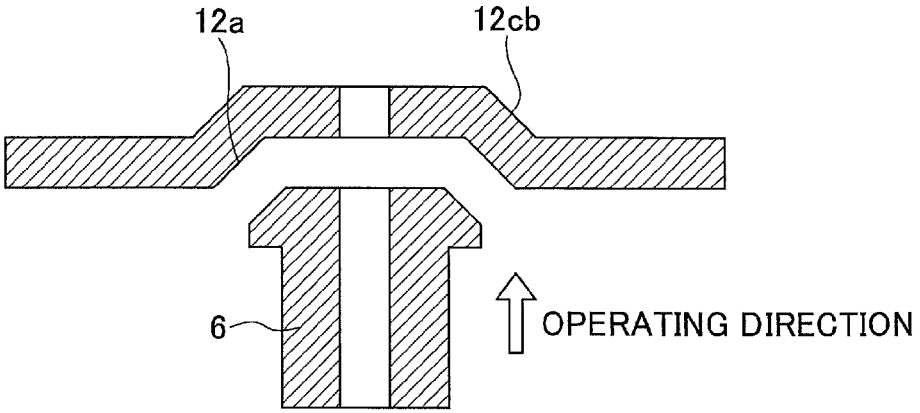
FIG. 8 schematically illustrates a convex part of the plunger, a concave part of the yoke, and a backside convex part of the yoke of the electromagnetic relay according to an embodiment of the present invention.

Note that in the case where the plunger 6 has the concave part 6*aa* and the yoke 12 has the convex part 12*aa* as illustrated in FIG. 4, a backside concave part 12*ca* may be arranged at the backside of the convex part 12*aa* so that the depths of the convex part 12*aa* and the concave part 6*aa* in the stroke direction may be increased. In this way, greater flexibility may be provided in optimizing the operating characteristics of the electromagnetic relay 1 of the present embodiment, for example. Similarly, in the case where the plunger 6 has the convex part 6*a* and the yoke 12 has the concave part 12*a*, a backside convex part 12*cb* may be arranged at the backside of the concave part 12*a* as illustrated in FIG. 8.

Figure 9:
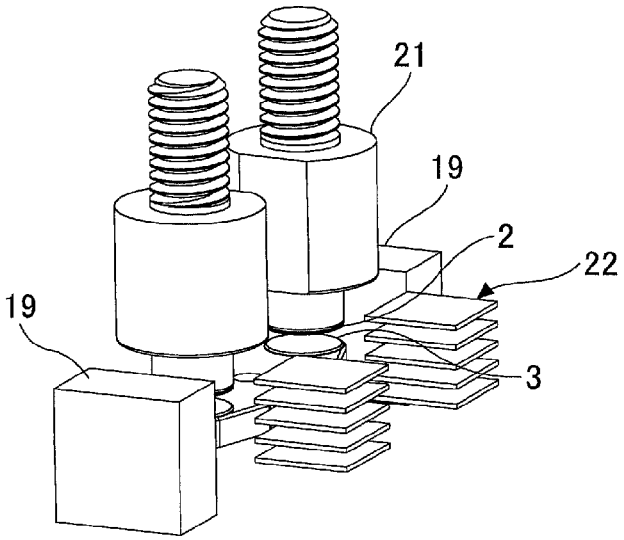
FIG. 9 schematically illustrates an arc-extinguishing grid arranged in the electromagnetic relay according to an embodiment of the present invention.
Figure 10:
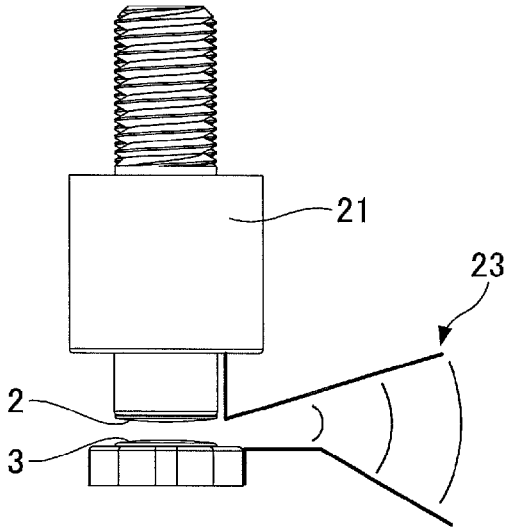
FIG. 10 schematically illustrates an arc runner arranged in the electromagnetic relay according to an embodiment of the present invention.

As illustrated in FIG. 9, in certain embodiments, an arc extinguishing grid 22 including a plurality of flat plates made of ferrous material stacked on each other may be arranged according to the direction of the Lorentz force in the electromagnetic relay 1, for example. In this way, an arc may be divided up and absorbed by the plurality of plates to realize arc extinction. Also, as illustrated in FIG. 10, a horn-shaped arc runner 23 made of a copper-based material, for example, may be arranged in the electromagnetic relay 1, and arc extinction may be performed by gradually increasing the spatial distance of the arc, for example.

Figure 11:
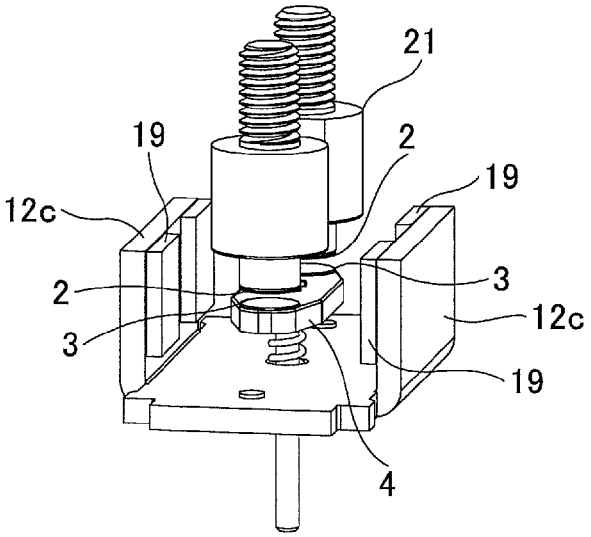
FIG. 11 schematically illustrates extension parts of the yoke for holding permanent magnets in the electromagnetic relay according to an embodiment of the present invention.

Note that in the above embodiment, to have the fixed core hold the permanent magnets 19, the extension parts 10*c* extending from the yoke 10 are arranged to hold the permanent magnets 19. However, in other embodiments, as illustrated in FIG. 11, extension parts 12*c* extending from the yoke 12 may be arranged to hold two pairs of the permanent magnets 19, for example. Note that the yoke 12 may be formed by bending a yoke plate material into a desired shape, for example. In this case, as illustrated in FIG. 11, the extension parts 12*c* may be formed such that the permanent magnets 19 may be polarized in a direction substantially perpendicular to the direction in which the pairs of the fixed contacts 2 and the movable contacts 3 are aligned, for example.

By having extension parts of a yoke hold the permanent magnets 19, a separate yoke does not have to be provided in the embodiments described above. In this way, an increase in the number of components may be avoided. Note that where two pairs of permanent magnets 19 are used as in the embodiment illustrated in FIG. 11, for example, the permanent magnets 19 facing each may be polarized in opposite directions so that when a direction of a voltage applied between the terminals S1 and S2; that is, the direction of the current flowing in the DC circuit as described above, is reversed, an arc may be prevented from being blown inward in a direction toward a contact as a result of the Lorenz force acting in an inward direction toward the contact, for example.

Figure 12:
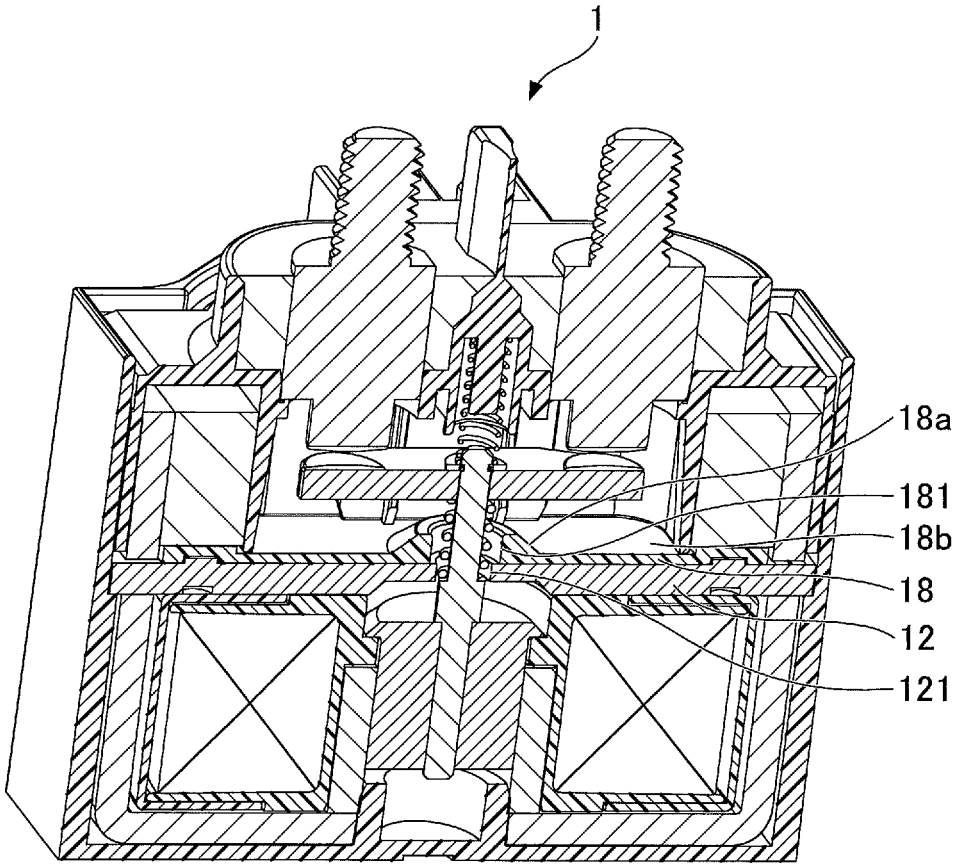
FIG. 12 schematically illustrates a sloped surface and a flat surface of a connection housing in the electromagnetic relay according to an embodiment of the present invention.

Further, as illustrated in FIG. 12, in the electromagnetic relay 1 according to a preferred embodiment, the connection housing 18 (resin molded member) is arranged at the contact part side of the yoke 12, and the connection housing 18 has a hole 181 corresponding to the through hole 121, a sloped surface 18*a* sloping toward the drive part 7 from the outer edge of the hole 181, and a flat surface 18*b* that extends outward from the outer edge of the sloped surface 18*a* in a direction substantially perpendicular to the shaft 5.

In the embodiment of FIG. 12, even when wear particles of the fixed contact 2 and the movable contact 3 fall onto the flat surface 18*b*, the sloped surface 18*a* may prevent the wear particles from moving in a radially inward direction, and the wear particles may be prevented from entering the hole 181 and the through hole 121 to interfere with the operation of the shaft 5.

Figure 13:
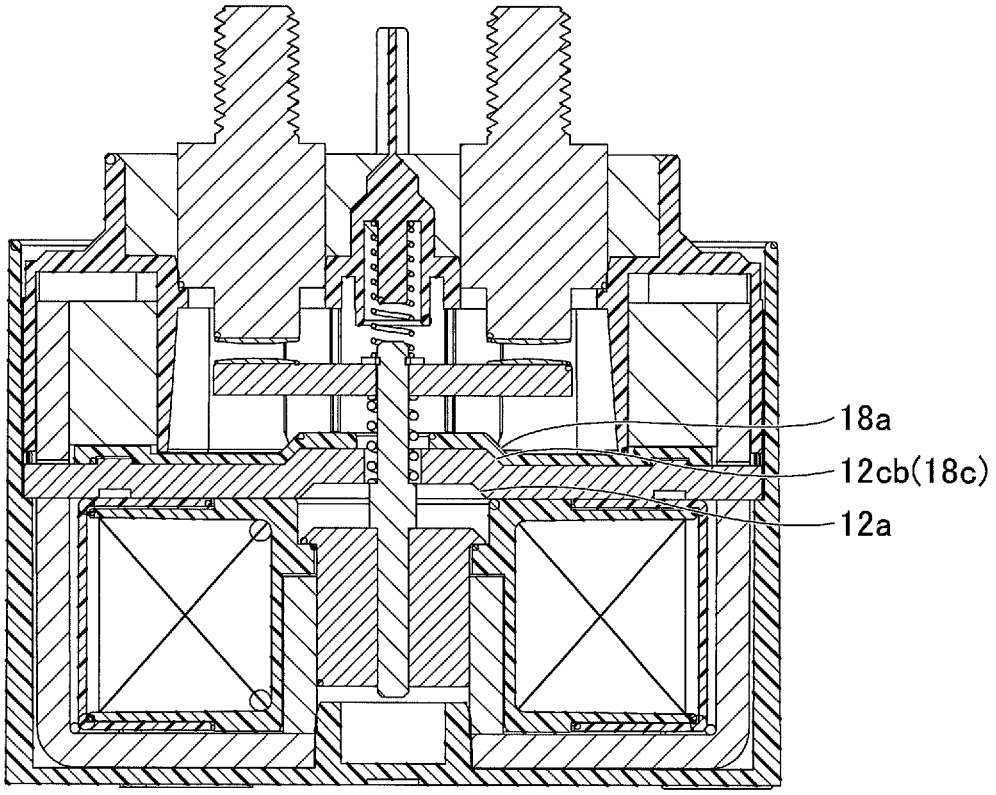
FIG. 13 schematically illustrates the connection housing in a case where the yoke includes a backside convex part in the electromagnetic relay according to an embodiment of the present invention.

Note that although the contact part side of the yoke 12 is arranged to be planar in the embodiment illustrated in FIG. 12, the present invention is not limited to such an embodiment. For example, as illustrated in FIG. 13, in the case where the yoke 12 includes the backside convex part 12*cb*, the thickness of the connection housing 18 at the sloped surface 18*a* and its surrounding area may be arranged to be thinner, and the connection housing 18 may be arranged to have a concave part 18*c* corresponding to the backside convex part 12*cb*, for example.

According to an aspect of the present invention, the structure of a fixed core of an electromagnetic relay may be simplified to thereby reduce costs and enable downsizing of the electromagnetic relay, for example. Embodiments of the present invention may be applied to various electromagnetic relays used in industrial and domestic settings, for example.

Further, the present invention is not limited to the embodiments described above, and various variations and modifications may be made without departing from the scope of the present invention.

Figure 14:
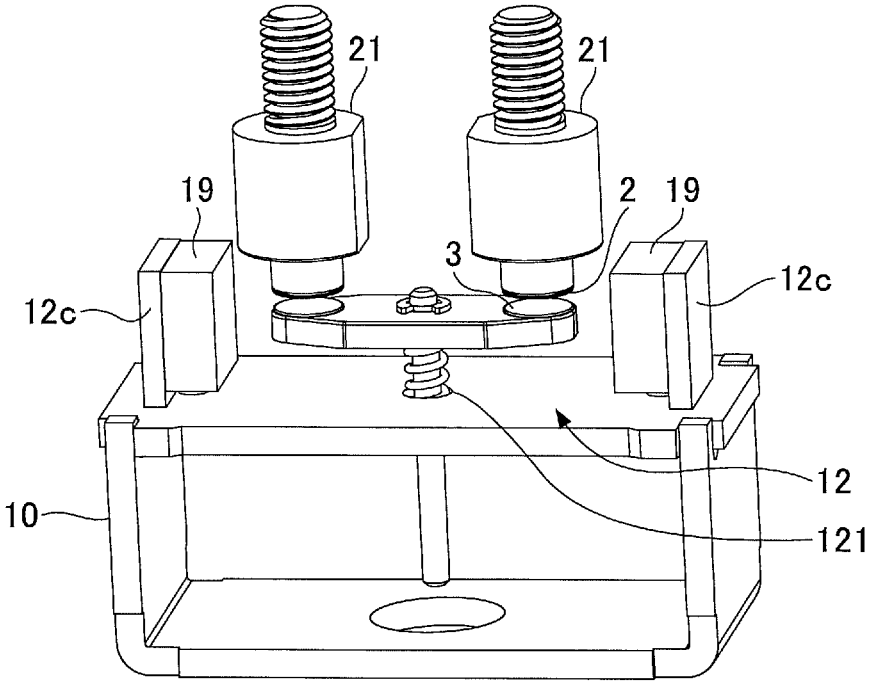
FIG. 14 schematically illustrates extension parts of the yoke for holding permanent magnets in the electromagnetic relay according to a modified embodiment.

For example, the extension parts 12*c* of the yoke do not necessarily have to be arranged into the configuration as illustrated in FIG. 12. In another embodiment, a pair of extension parts 12*c* may extend from positions shifted inward from the longitudinal direction side ends of the yoke 12 as illustrated in FIG. 14, for example. In this case, the extension parts 12*c* may be integrally formed with the yoke 12, or plate members corresponding to the extension parts 12*c* (i.e., separate members) may be arranged to come into contact with or attached to the yoke 12 afterwards to forma parts of the magnetic circuit, for example. In the case where the extension parts 12*c* are simply arranged to come into contact with the yoke 12, the extension parts 12*c* may be accommodated within corresponding accommodation parts (not shown) of the contact part housing 17 together with their corresponding permanent magnets 19, and the extension parts 12*c* may be arranged to come into contact with the yoke when the contact part housing 17 is assembled with the drive part housing 16, for example.

The present application is based on and claims priority to Japanese Patent Application No. 2013-174996 filed on Aug. 26, 2013, the entire contents of which are hereby incorporated by reference.

What is claimed is:

1. An electromagnetic relay comprising:

a contact part including a fixed contact and a movable contact, the movable contact being displaceable in an approaching/separating direction with respect to the fixed contact;

a drive part including a coil, a movable core, and a fixed core, the movable core being connected to the movable contact via an axial core, and the fixed core including a first plate member having a through hole through which the axial core is inserted and a second plate member that encapsulates the coil;

a permanent magnet polarized in a direction substantially perpendicular to the approaching/separating direction; and a resin molded member arranged at a side of the first plate member toward the contact part, the resin molded member including a hole corresponding to the first through hole, a sloped surface extending from an outer periphery of the hole toward the drive part, and a flat surface extending from an outer periphery of the sloped surface in a direction substantially perpendicular to the axial core, wherein the first plate member or the second plate member includes an extension part that extends toward the contact part, the extension part being configured to hold the permanent magnet, and wherein the extension part is formed by bending one of the first plate member and the second plate member to hold the permanent magnet.

2. The electromagnetic relay as claimed in claim 1, further comprising:

an arc extinguishing part configured to extinguish an arc generated between the fixed contact and the movable contact.

3. The electromagnetic relay as claimed in claim 2, wherein the arc extinguishing part includes at least one of an arc extinguishing grid and an arc runner.

4. The electromagnetic relay as claimed in claim 1, wherein the first plate member and the second plate member are yokes, and wherein the extension part is integrated with the yokes.

* * * * *